United States Patent [19]

Tanimoto

[11] Patent Number: 4,681,425

[45] Date of Patent: Jul. 21, 1987

[54] IMAGE FORMING APPARATUS

[75] Inventor: Yasufumi Tanimoto, Fujisawa, Japan

[73] Assignee: Kabushiki Kaisha Toshiba, Kawasaki, Japan

[21] Appl. No.: 919,697

[22] Filed: Oct. 16, 1986

[30] Foreign Application Priority Data

Oct. 24, 1985 [JP] Japan ..... 60-239221

[51] Int. Cl.[4] ..... G03G 15/00; G03G 15/01

[52] U.S. Cl. ..... 355/14 CU; 355/14 C; 355/3 SH; 355/14 R; 355/14 SH

[58] Field of Search ..... 355/14 C, 14 CU, 3 SH, 355/3 DR, 14 R, 14 SH

[56] References Cited

U.S. PATENT DOCUMENTS

| | | | |
|---|---|---|---|
| 4,329,046 | 5/1982 | Burkett et al. | 355/14 SH |
| 4,330,200 | 5/1982 | Kikuchi et al. | 355/14 SH |
| 4,472,049 | 9/1984 | Honma et al. | 355/3 SH |
| 4,521,102 | 6/1985 | Motomura et al. | 355/14 CU |

*Primary Examiner*—Arthur T. Grimley
*Assistant Examiner*—Ed Pipala
*Attorney, Agent, or Firm*—Banner, Birch, McKie & Beckett

[57] ABSTRACT

An image forming apparatus includes a paper delivery detecting switch provided near the paper delivery opening, a paper presence detecting structure to detect the presence of the paper on the receiving tray, a counter circuit and a comparator. The counter circuit counts up the number of delivered paper on the receiving tray in response to a delivered paper signal from the paper delivery detecting switch and a paper presence signal from the paper presence detecting structure. The comparator compares the value of number of delivered paper counted up by the counter circuit and a delivery quantity limit value preset in the apparatus main body, and halts the image forming operation when the two values coincide.

7 Claims, 4 Drawing Figures

IMAGE FORMING APPARATUS

BACKGROUND OF THE INVENTION

1. Field of the Invention

The present invention relates to an improvement of an image forming apparatus in which use of the apparatus can be automatically halted when the amount of paper delivered reaches a set amount.

2. Description of the Prior Art

There are occasions when printers, e.g., copying apparatus or similar apparatus, have to print a large amount of copies, because copies are produced using an automatic document feeder or because printing is effected in response to a large volume of print signals from a computer or similar host system. As it is desirable in such cases to have the output copies arranged in their page order, it is necessary to prevent the copies from spilling from the receiving tray.

In the conventional image forming apparatus, it has been necessary for someone to make occasional checks on the progress of the print out. However, when an office is busy, it is very easy to forget to do this, and so copies can overflow and fall from the receiving tray, resulting in the copies becoming disordered or even lost. When this happens, rearranging the copies represents a considerable waste of time and there is, therefore, a strong demand for improvement in this respect.

SUMMARY OF THE INVENTION

It is an object of the invention to provide an image forming apparatus in which use of the apparatus is automatically inhibited when the number of copies reaches a set amount.

According to one aspect of the present invention, there is provided an image forming apparatus including a main body having a paper delivery opening, an image forming means provided in the main body for forming an image on the paper and a receiving tray provided at the paper delivery opening to receive the paper delivered from the paper delivery opening, the improvement comprising:

- delivery paper detecting means provided near the paper delivery opening for detecting the passage of the paper delivered and outputting a first signal representing the passage of the paper;
- paper presence detecting means for detecting the presence of the paper delivered on the receiving tray and outputting a second signal representing the presence of the paper;
- count means for counting the number of the paper delivered on the receiving tray upon the first and second signals and outputting a third signal representing the number of the paper delivered;
- memory means for storing a delivery quantity limit value and outputting a fourth signal representing the number of the paper corresponding to the delivery quantity limit value;
- comparing means for comparing the third signal with the fourth signal and outputting the coincidence signal when the two signals coincide; and
- operation halt means for halting the image forming means in response to the coincidence signal from the comparing means.

DETAILED DESCRIPTION OF THE PREFERRED EMBODIMENTS

Preferred embodiments of the present invention will be described with reference to the accompanying drawings.

Figure 1:
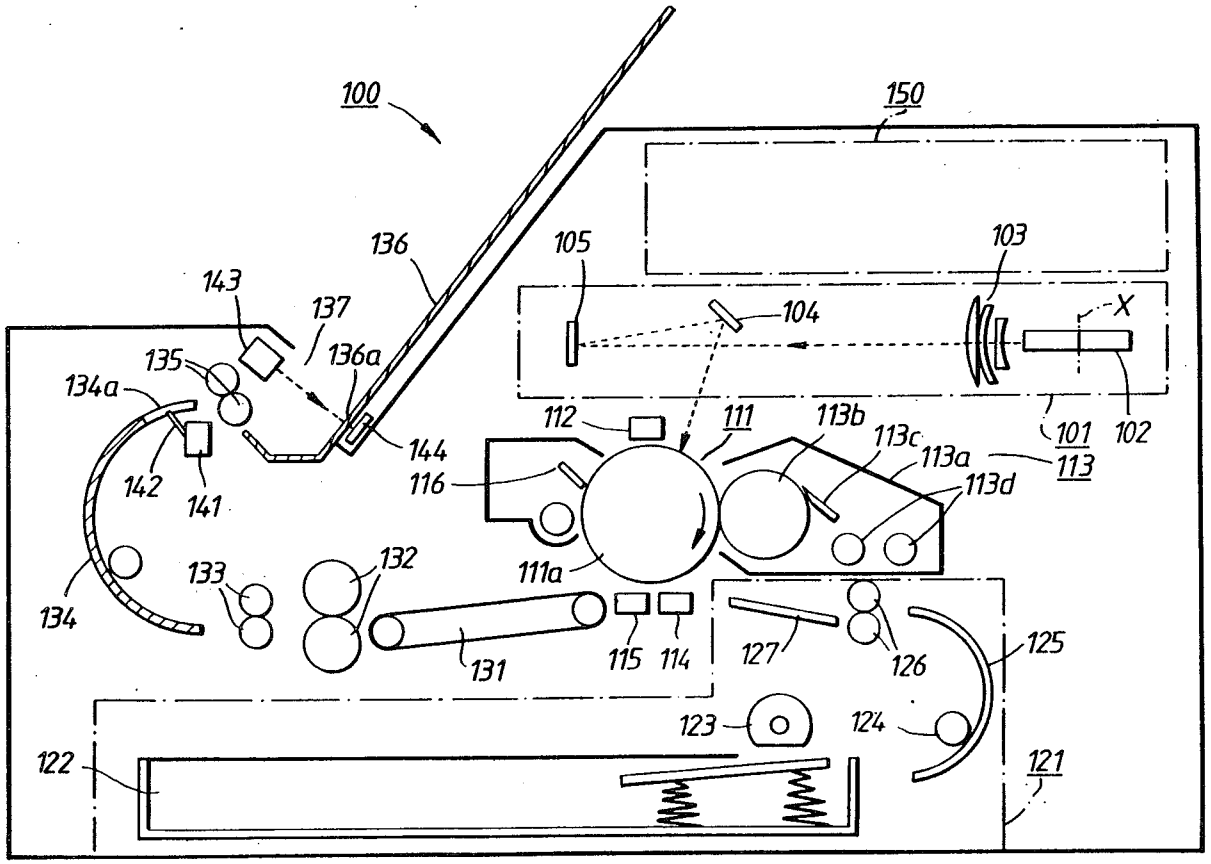
FIG. 1 is an outline view of one embodiment of the invention.

FIG. 1 is a schematic sectional view of a laser printer according to the present invention. Reference numeral 100 denotes a printer main body. An optical system 101 is provided in main body 100. Optical system 101 includes a polygon mirror 102, a lens group 103 and a set of reflecting mirrors 104 and 105. Polygon mirror 102 is rotatable about the X axis by a suitable means, and a laser light, source (not shown), which is provided in a vertical position with respect to the plan of the paper, is directed by polygon mirror 102 onto lens group 103.

A photosensitive drum unit 111, constructed as a cartridge, is replaceably mounted in main body 100. A main charger 112, a cartridge unit type developing device 113, a transfer charger 114, a separation charge 115 and a cleaning blade 116 are arranged around a photosensitive drum 11*a*. Drum 11*a* rotates in the direction shown. Developing device unit 113 comprises known structural elements such as a casing 113*a*, a magnetic roller 113*b*, a developing agent separation blade 113*c* and a stirring auger 113*d*. Casing 113*a* contains a two-component developing agent comprising a mixture of carrier particles and toner powder. Developing device unit 113 is constructed as a cartridge and is replaceably mounted in main body 100.

An exchangeable cassette type paper supply section 121 consists of a paper supply cassette 122, a paper supply roller 123, an intermediate transporting roller 124, a first guide plate 125, a pair of aligning rollers 126 and a second guide plate 127. Paper supply roller 123 defines an approximate semicircle, as shown, and when it rotates one turn, a leading edge portion of a sheet of cut paper (not shown), stacked in paper supply cassette 122, is supplied to the right as seen in the drawing. The length of this leading edge portion corresponds to the effective circumferential length of roller 123. The sheet of paper is then led via first guide plate 125, intermediate transporting roller 124, aligning rollers 126 and second guide plate 127 to photosensitive drum 111*a*.

Numeral 131 denotes a transport belt for leading the paper to a thermal fixing roller 132 in a subsequent stage following the transfer of toner onto the paper. Numeral 133 denotes an intermediate roller by which, following fixing, the paper is led via a third guide plate 134 and delivery rollers 135 to a receiving tray 136 provided at a delivery opening 137.

Figure 3:
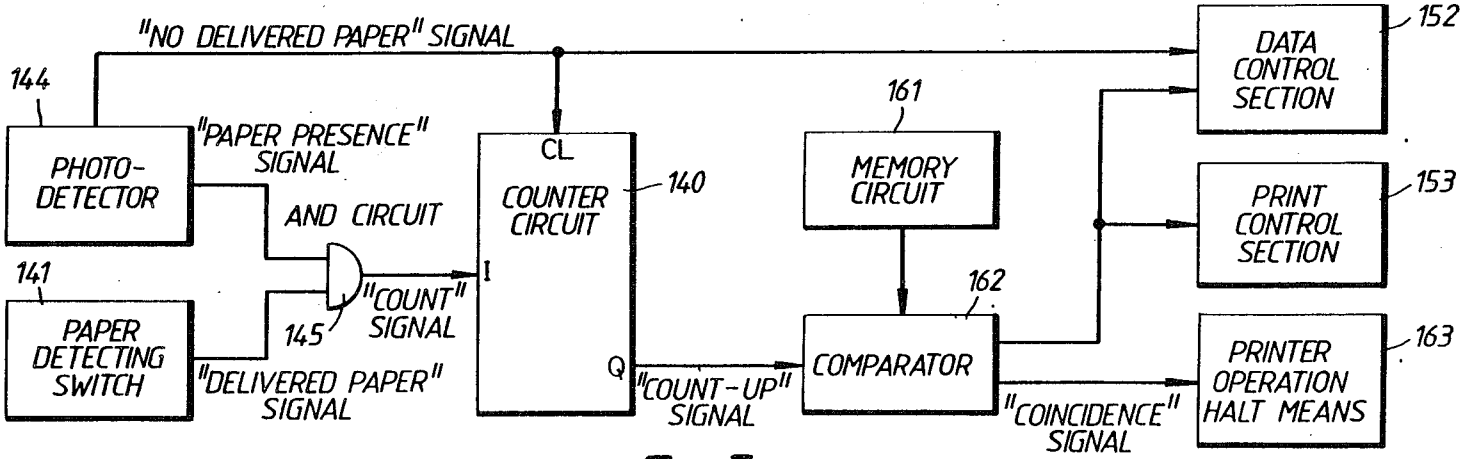
FIG. 3 is a block diagram from explaining the circuit operation which ensures delivery of a proper quantity of paper.

Numeral 141 denotes a paper detecting switch for detecting the passage of copied papers that are delivered. Paper detecting switch 141 comprises an actuator 142 which projects into a cut-out portion 134*a* formed at the upper end of third guide plate 134. Copied paper being delivered pushes down actuator 142 as it passes and, as shown in FIG. 3, a passage signal (i.e., a "Delivered paper" signal) is outputted. This "Delivered paper" signal is continuously supplied to an AND circuit 145 while the copied paper pushes down actuator 142. A light source 143 and a photodetector 144, provided near delivery opening 137, constitute a paper delivery detection means that, detects whether the paper sheet is present via a detection hole 136*a* formed near the lower edge of receiving tray 136.

A light beam from light source 143 is directed, via hole 136*a*, onto photodetector 144. When this light beam is cut off by the presence of copied paper delivered onto receiving tray 136, a "Paper presence" signal (indicating that delivered paper is present on receiving tray 136) is supplied as an output. This detection signal is supplied to AND circuit 145. The "Paper presence" signal and the "Delivered paper" signal are supplied to AND circuit 145, and AND circuit 145 outputs a "Count" signal. This "Count" signal is supplied to an input terminal I of a counter circuit 140 and counter circuit 140 counts "+1". Counter circuit 140 comprises a shift register as is well known in the art. If no copied paper is present on receiving tray 136 and the light beam from light source 143 is continuously incident on photodetector 144, a "NO delivered paper" signal from photodetector 144 is supplied to a clear terminal CL of counter circuit 140, which clears counter circuit 140.

Still referring to FIG. 3, numeral 161 denotes a memory circuit which stores a delivery quantity limit value. The delivery quantity limit value is determined by the permissible quantity that can be held by receiving tray 136 and is, for example, set at the value of 250 sheets. Numeral 162 denotes a comparator for comparing the delivery quantity limit value with the cumulative value of the "Count-up" signals from counter circuit 140. Comparator 162 is constructed so that when the two values are the same it supplies a "Coincidence" signal to a printer operation halt means 163, which will be described later.

Figure 2:
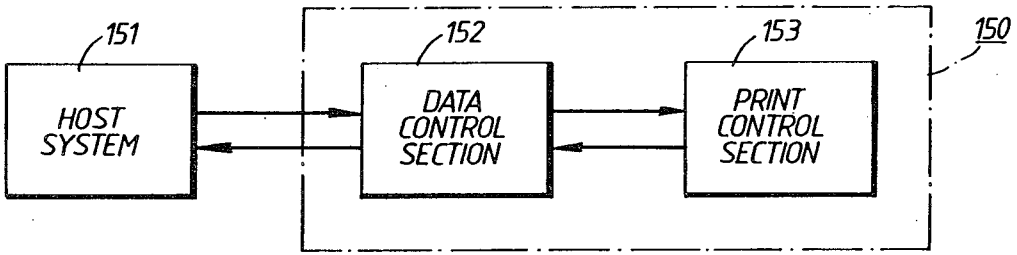
FIG. 2 is a block diagram of a circuit for printer control.

Returning to FIG. 1, numeral 150 denotes a control circuit device that effects control of the printer. As shown in FIG. 2, control circuit device 150 comprises a data control section 152 and a print control section 153. A host system 151, for example a computer or word processor, is connected to data control section 152 of control circuit device 150. Code data from host system 151 is converted into dot-image data and stored in a page memory (not shown) in data control section 152. This stored dot-image data is output to print control section 153. In print control section 153, a laser beam is modulated in accordance with the input dot-image data from data control section 152 and is directed onto photosensitive drum 111 via optical system 101. This permits subsequent production of a copy of the electrophotographic system.

The operation of an image forming apparatus thus arranged will be described. Operational procedure for using a printer according to the invention is the same as for a conventional apparatus and the action is started by pressing a print start button (not shown). When this is done, control by printing control section 153 in accordance with data from data control section 152 results in formation of an electrostatic latent image on photosensitive drum 111 in accordance with the given data. The electrostatic latent image is converted to a toner image by developing device unit 113. Subsequently in the transfer stage, the toner image is transferred onto a sheet of paper forwarded from paper supply cassette 122 and the transferred image is fixed. As a result, a hard copy is produced which is fed to receiving tray 136 by the action of intermediate roller 133 and third guide plate 134 and delivery roller 135.

When this is done, the "Delivered paper" signal and "Paper presence" signal cause counter circuit 140 to continue counting up, as described above. If the number of delivered copied paper reaches the limit of the permissible capacity of receiving tray 136, this is detected by comparator 162. As a result, comparator 162 supplies the "Coincidence" signal to a printer operation halt means 163, whereby the printer main body 100 is brought into a state whereby its use is inhibited. Since this can happen while paper is still in the process of being printed and remains inside main body 100, main body 100 must be actuated up until the time this paper is copied and is fed out onto receiving tray 136, but with its further use still kept inhibited during this actuation. Thus, a suitable quantity of copied paper is obtained on receiving tray 136 with spilling and scattering of the delivered copies prevented.

In this case, data control section 152 and print control section 153 are also supplied with a coincidence signal to stop their operation, as shown in FIG. 3, but printing can continue in accordance with the print data remaining in the page memory of data control section 152. If a page memory is dispensed with the print signals are introduced directly into print control section 153 from host system 151, the above-noted "Coincidence" signal results in any remaining print signals being stored in a separately provided memory for continued printing.

Figure 4:
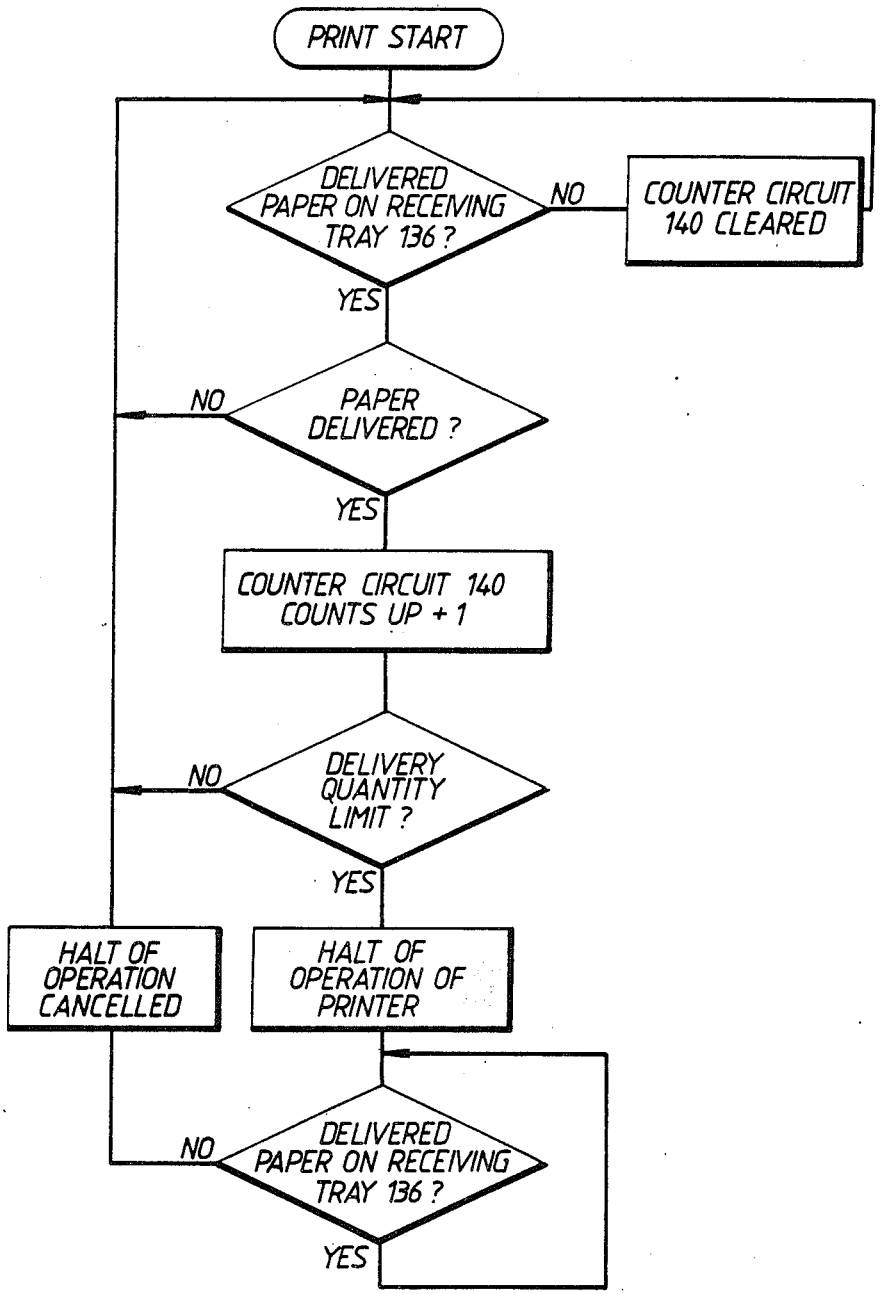
FIG. 4 is a flowchart relating to the block diagram of FIG. 3.

When the delivered copied paper reaches the limit of the delivery quantity limit value and then removed from receiving tray 136, the light beam from light source 143, via detection hole 136*a*, passes onto photodetector 144. Photodetector 144 then outputs the "No delivered paper" signal. This "No delivered paper" signal is supplied to counter circuit 140 to clear circuit 140. Simultanuously, the "No delivered paper" signal is transferred to host system 151 via data control section 152 so that the printer can be again operated. FIG. 4 is a flowchart showing the operational flow in a printer according to the invention described above.

It should be understood that the present invention may be changed and modified in various ways, all within the scope of the invention.

As described above, use of the invention makes it possible to bring an image forming apparatus into a state in which its use is inhibited when a suitable quantity of copies have been delivered following printing, thereby offering the advantage that scattering of copies is prevented whereby work can be conducted more efficiently.

I claim:

1. In an image forming apparatus including a main body having a paper delivery opening, an image forming means in the main body for forming an image on the paper and a receiving tray provided at the paper delivery opening to receive the paper delivered from the paper delivery opening, the improvement comprising:

delivery paper detecting means provided near the paper delivery opening for detecting the passage of the paper delivered and outputting a first signal representing the passage of the paper;

paper presence detecting means for detecting the presence of the paper delivered on the receiving tray and outputting a second signal representing the presence of the paper;

count means for counting the number of the paper delivered on the receiving tray upon the first and second signals and outputting a third signal representing the number of the paper delivered;

memory means for storing a delivery quantity limit value and outputting a fourth signal representing the number of the paper corresponding to the delivery quantity limit value;

comparing means for comparing the third signal with the fourth signal and outputting the coincidence signal when the two signals coincide; and operation halt means for halting the image forming means in response to the coincidence signal from the comparing means.

2. The apparatus according to claim 1, wherein the delivery detecting means includes a switch having an actuator on which the paper pass to generates the first signal.

3. The apparatus according to claim 1, wherein the paper presence detecting means includes a light source and a photodetector receives a light beam from the light source, the photodetector generates the second signal when the light beam is cut off by the paper delivered on the receiving tray.

4. The apparatus according to claim 3, wherein the light source is provided above the receiving tray and the photodetector is opposed the light source via a detection hole formed to the receiving tray.

5. The apparatus according to claim 1, wherein the count means includes a counter circuit and an AND circuit to be input the first and second signals and outputs a count signal input to the counter circuit.

6. The apparatus according to claim 5, wherein the counter circuit comprises a shift register.

7. The apparatus according to claim 1, wherein the count means is cleared in response to a signal generated from the paper presence detecting means when it detects no delivered paper.

* * * * *